US006588246B2

(12) United States Patent
Ko

(10) Patent No.: US 6,588,246 B2
(45) Date of Patent: Jul. 8, 2003

(54) FINELY ADJUSTABLE SWIVEL HEAD OF A RIVET TOOL WITH CLICKING SOUND

(76) Inventor: Yung-Chang Ko, 7th Fl., No. 21, Sec. 3, Minsheng E. Rd., Taipei (TW)

( * ) Notice: Subject to any disclaimer, the term of this patent is extended or adjusted under 35 U.S.C. 154(b) by 0 days.

(21) Appl. No.: 10/035,570

(22) Filed: Oct. 22, 2001

(65) Prior Publication Data

US 2002/0194720 A1 Dec. 26, 2002

(30) Foreign Application Priority Data

Jun. 22, 2001 (TW) ..... 90210588 U

(51) Int. Cl.[7] ..... B21J 15/34; B21D 9/05

(52) U.S. Cl. ..... 72/243.528; 72/391.4; 72/477

(58) Field of Search ..... 72/391.4, 477; 29/243.528, 243.521

(56) References Cited

U.S. PATENT DOCUMENTS 1,142,797 A * 6/1915 Burrell ..... 72/477
4,344,311 A * 8/1982 Inoue ..... 29/243.528
4,347,729 A * 9/1982 Mitani ..... 29/243.528
4,552,010 A * 11/1985 Hein ..... 29/243.528
4,807,460 A * 2/1989 Tzong ..... 29/243.528
5,361,474 A * 11/1994 Yang ..... 29/243.528

* cited by examiner

*Primary Examiner*—David Jones
(74) *Attorney, Agent, or Firm*—David A. Belasco; Belasco Jacobs & Townsley, LLP

(57) ABSTRACT

A rivet tool/rivet nut tool/rivet bolt tool with a freely-rotatable and finely-adjustable head has a handle pivotally connected to a lever and a swivel head rotatably connected to the handle. The swivel head can be finely-adjusted by use of a [steering] gear and a slidable gear lock. The slidable gear lock has an inverted V top with a tip to mesh with the gear by the recovery force of a spring, whereby the swivel head can be finely-adjusted and whenever the swivel head is rotated, a clicking sound is made to inform a user. The back-and-forth movement of the slidable gear lock can be as a complement to the tip of the slidable gear lock and teeth of the gear to prolong the operation life of the slidable gear lock, steering gear and the rivet tool/rivet nut tool/rivet bolt tool.

8 Claims, 4 Drawing Sheets

FINELY ADJUSTABLE SWIVEL HEAD OF A RIVET TOOL WITH CLICKING SOUND

BACKGROUND OF THE INVENTION

1. Field of the Invention

The present invention relates to a rivet tool, and more particularly to a finely adjustable swivel head of a rivet tool with clicking sound. The rivet toot has a gear, a positioning element, and a spring such that the spring can push the positioning element to mesh with the gear to provide a fine adjustment of the swivel head of the rivet tool with clicking sound to inform the user.

2. Description of Related Art

A rivet tool is commonly used in fastening of two or more work pieces. To use the rivet tool to fasten the work pieces, holes are drilled in the work pieces which are then placed at a position such that the holes communicate with each other, and a blind rivet is disposed in the holes. The rivet tool is then used to deform the blind rivet in the holes, and by doing this, the work pieces are securely fastened together by the deformed blind rivet.

A rivet nut tool having same riveting mechanism as that of the rivet tool is getting popular to fasten blind rivet nut or called threaded insert firmly and build up the female threads securely in the thin base metals and pipes, etc. A hole is drilled in the work piece, a blind rivet nut is firstly screwed onto the threaded mandrel of the rivet nut tool and then disposed in the hole. The rivet nut tool is then used to deform the blind rivet nut in the hole, and by doing this, the female threads of the blind rivet nut are securely built up in the work piece by the deformed blind rivet nut.

A rivet bolt tool having same riveting mechanism as that of the rivet tool is also getting popular to fasten blind rivet bolt or called stud firmly and build up the male threads securely on the thin base metals and pipes, etc. A hole is drilled in the work piece, a blind rivet bolt is firstly screwed into the threaded socket of the rivet bolt tool and then disposed in the hole. The rivet bolt tool is then used to deform the blind rivet bolt in the hole, and by doing this, the male threads of the blind rivet bolt are securely built up on the work piece by the deformed blind rivet bolt.

To save description of the related three kinds of tool, they are rivet tool, rivet nut tool and rivet bolt tool, to this invention, the following description only mentions "rivet tool" to represent the related three kinds of the tool.

A conventional rivet tool has a head and a handle integrally formed, such that the head cannot rotate with respect to the handle. Thus when operating in a restricted space, a user of the conventional rivet tool may have difficulty in performing the riveting task.

In order to obviate the mentioned problem, an improved rivet tool having a rotatable head with a positioning device to control the rotation of the head is designed. The positioning device can be a commonly seen spring ball combination and corresponding recesses to enable the head to be rotatable with respect to a handle and to be positioned at a selected angle. However the positioning device used only can provide the limited rotatable angle, and can not provide a fine adjustment of the swivel head, thus further improvement is needed.

A further improved rivet tool having a freely rotatable head is designed. Although the head is able to rotate freely to be usable in a restricted space, a problem may arise due to the free rotation of the head. That is, the head may undesirably rotate during operation and a user may not alert that might result in the defective riveting work, and therefore further improvement is still desired.

To overcome the shortcomings, the present invention tends to provide a rivet tool with a freely rotatable and finely adjustable head having clicking sound to mitigate or obviate the aforementioned problems.

SUMMARY OF THE INVENTION

The objective of the present invention is to provide a rivet tool with a freely-rotatable and finely adjustable head such that the head can be finely and appropriately adjusted to a desired position.

Another objective of the present invention is to provide a rivet tool with a freely rotatable and finely adjustable head such that a clicking sound is made whenever the head is swiveled such that even the fine adjustment can be easily verified and a user can be alerted to an undesired rotation of the head.

Another objective of the present invention is to provide a rivet tool with a freely-rotatable and finely-adjustable head that includes a gear, a slidable gear lock with an inverted V-top which has a tip and a spring, wherein the inverted V-top can function as a complement to the tip of the slidable gear lock that meshes to a gear by the resilience of the spring, whereby the operation life of the slidable gear lock, the gear and the rivet tool is prolonged.

Other objectives, advantages and novel features of the invention will become more apparent from the following detailed description when taken in conjunction with the accompanying drawings.

BRIEF DESCRIPTION OF THE DRAWINGS

FIGS. 4–6 are a series of lateral, cross-sectional top views of the rivet tool, wherein FIG. 4 is taken along line 4—4 in FIG. 2.

DETAILED DESCRIPTION OF THE PREFERRED EMBODIMENT

Figure 1:
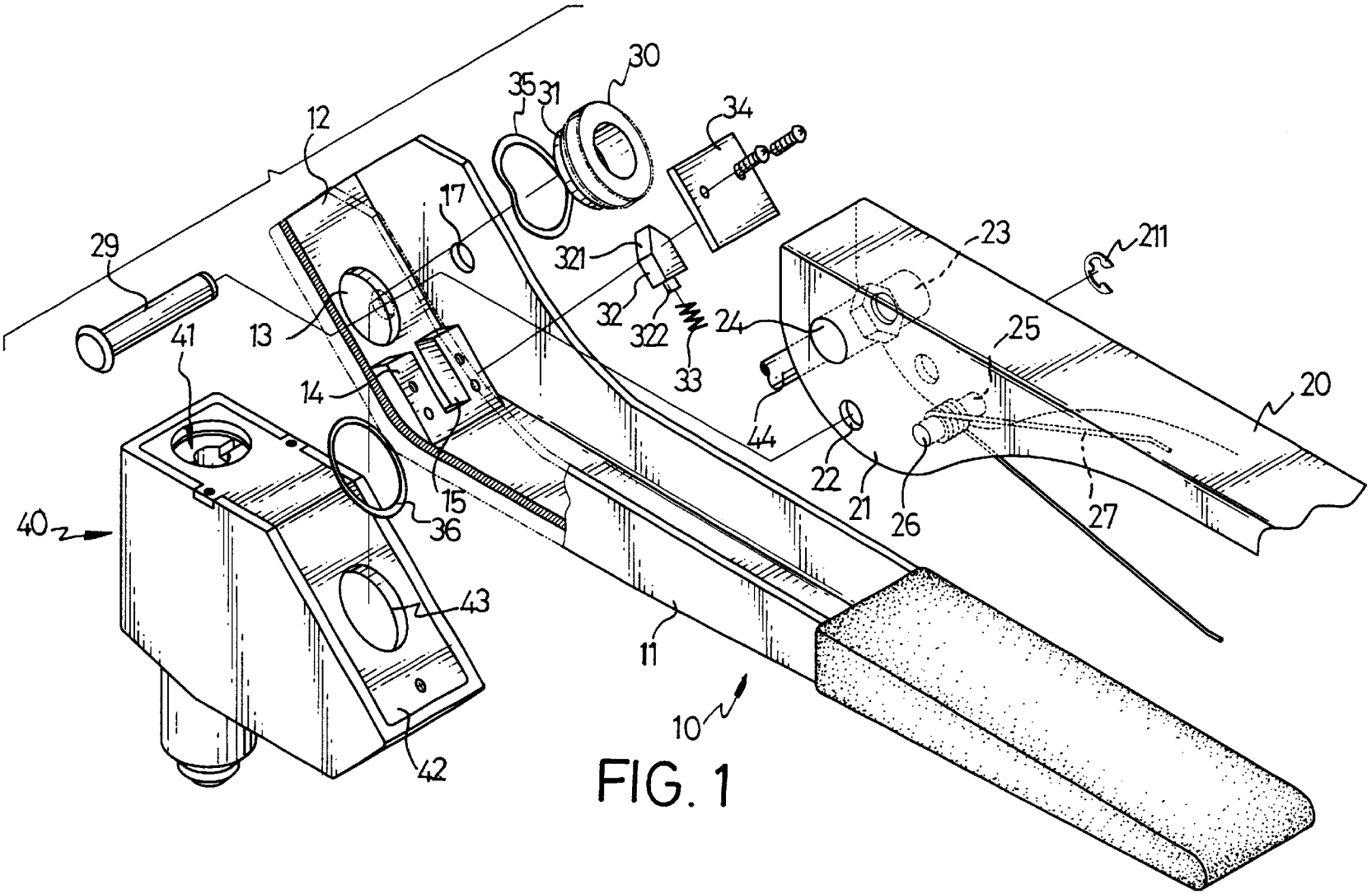
FIG. 1 is an exploded, perspective view of a rivet tool with a freely rotatable and finely adjustable head in accordance with the present invention.
Figure 2:
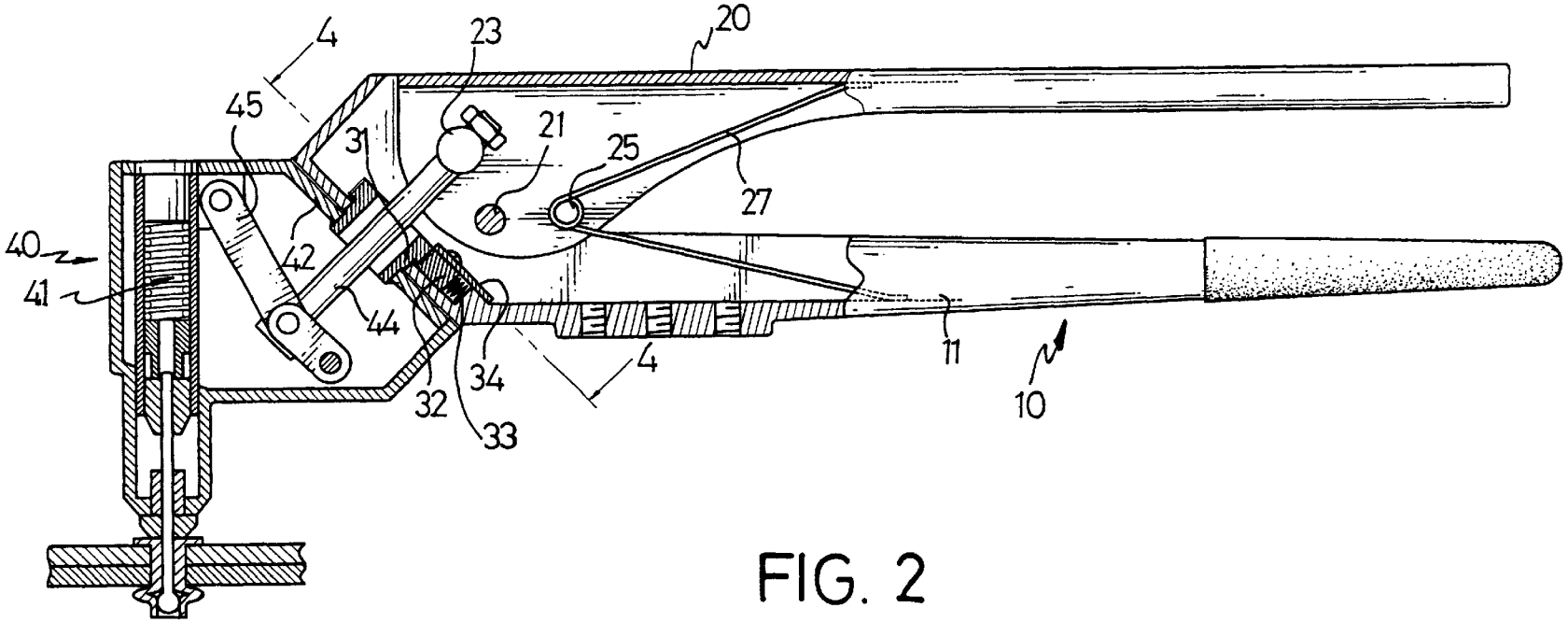
FIG. 2 is a longitudinal cross-section of the rivet tool.

With reference to FIGS. 1 and 2, a rivet tool with a freely rotatable and finely adjustable head in accordance with the present invention has a handle (10), a lever (20), a steering gear (30), and a swivel head (40).

The handle (10) has two walls (11) oppositely formed along a lengthwise direction of the handle (10) and a first slope (12) formed in a front portion of the handle (10). The first slope (12) defines a first through hole (13), and a protruding piece (14) is formed adjacent to the first through hole (13). The protruding piece (14) can be either integrally formed with the handle (10) or securely connected to the handle (10) by welding or riveting. The protruding piece (14) defines a socket (15). Two bolt holes (17) are oppositely defined in the walls (11) and at the front portion of the handle (10).

The lever (20) has two walls (21) oppositely formed along a lengthwise direction of the lever (20), and two bolt holes (22) are oppositely defined in front portions of the walls (21) of the lever (20). The lever (20) and the handle (10) are pivotally connected together using a fulcrum bolt (29) that extends through the bolt holes (17) in the handle (10) and the bolt holes (22) in the lever (20). The fulcrum bolt (29) has a flange end and a groove end such that the fulcrum bolt (29) is securely retained in the bolt holes (17) by abutting the flange end to one of the walls (11) of the handle (10) and adding a retaining ring (211) around the groove end to abut the other wall (11) of the handle (10). Two shaft holes (24) are oppositely defined in the front portions of the walls (21) to allow a shaft (23) to extend therethrough. The shaft (23) connects to a rod (44) of the swivel head (40). Two pin holes (26) are oppositely defined in the front portions of the walls (21) and a pin (25) with a torsion spring (27) mounted therearound extends through the pin holes (26). The torsion spring (27) has two slender feet abutting to the handle (10) and the lever (20) respectively such that the torsion spring (27) is able to provide resilience to the lever (20) and the handle (10).

The swivel head (40) has a collet tube (41) with a riveting mechanism that is able to deform a blind rivet to fasten work pieces together. The swivel head (40) has a second slope (42) to engage the first slope (12) of the handle (10), and the second slope (42) has a second through hole (43) to communicate with the first through hole (13).

Figure 3:
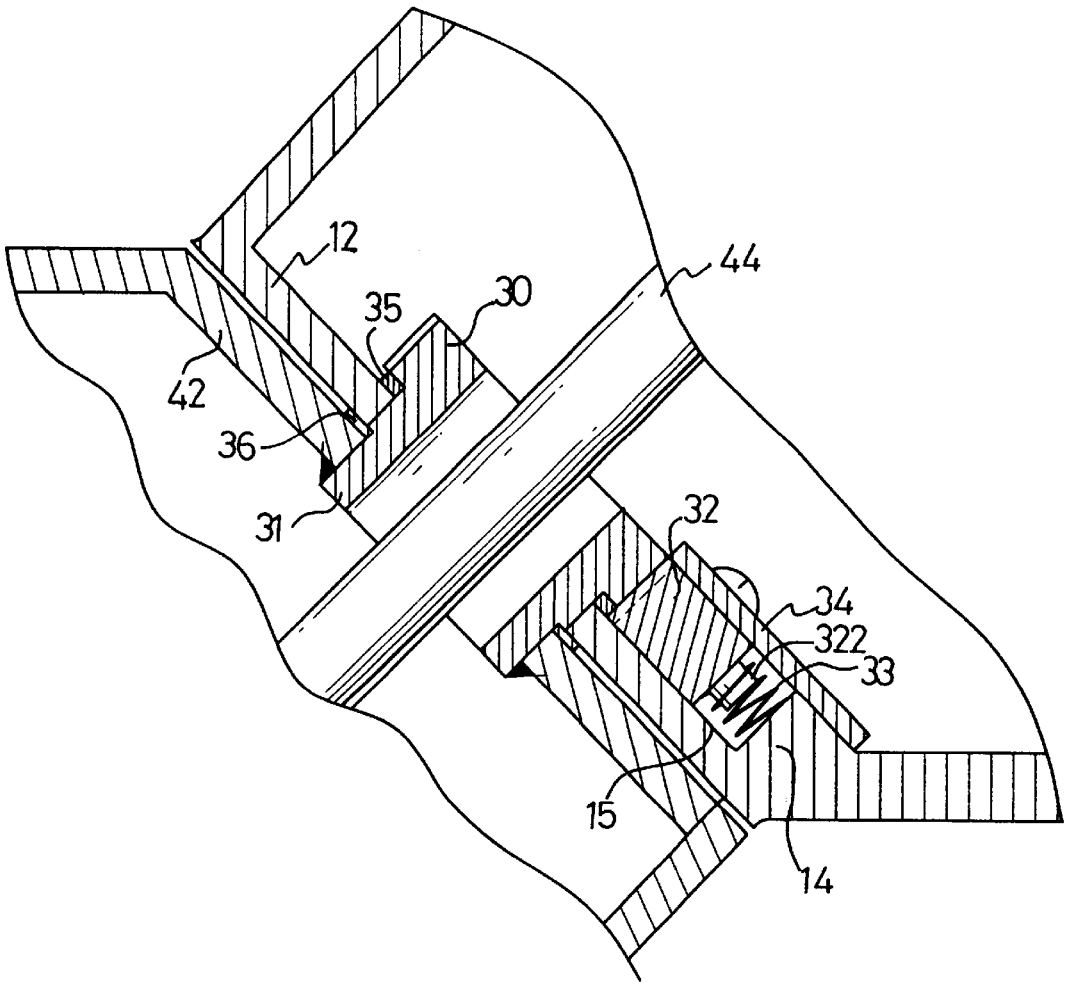
FIG. 3 is a partially enlarged cross-sectional view of the rivet tool.

With reference specifically to FIG. 3, the gear (30) is integrally formed on a hollow axle (31). The hollow axle (31) extends through the first through hole (13) and the second through hole (43) with a step portion of the steering gear (30) abutting the front slope (12) defining the first through hole (13). An opposite portion of the hollow axle (31) with respect to the gear (30) is securely connected to the back slope (42) defining the second through hole (43) by welding as shown in FIG. 3 or by riveting. A leaf spring (35) and a washer (36) are mounted around the hollow axle (31). The leaf spring (35) is sandwiched between the gear (30) and the first slope (12) to occupy a gap between the steering gear (30) and the first slope (12). The washer (36) is sandwiched between the first slope (12) and the second slope (42) to reduce rubbing therebetween.

Figure 4:
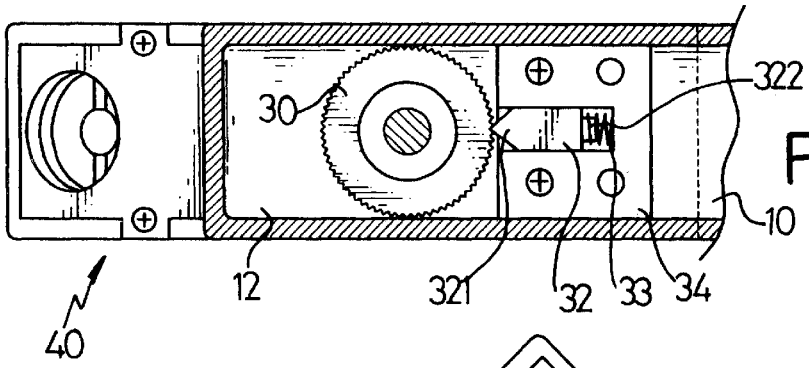
Figure 5:
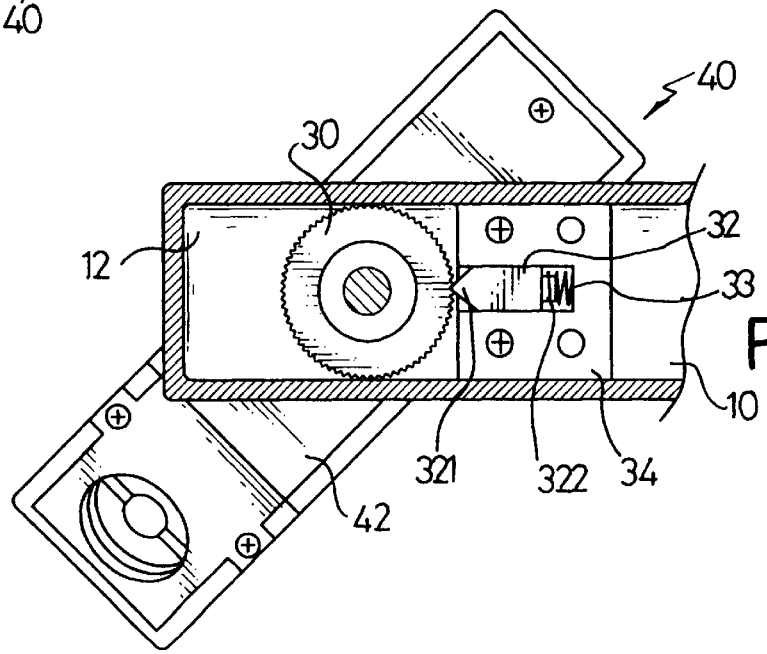
Figure 6:
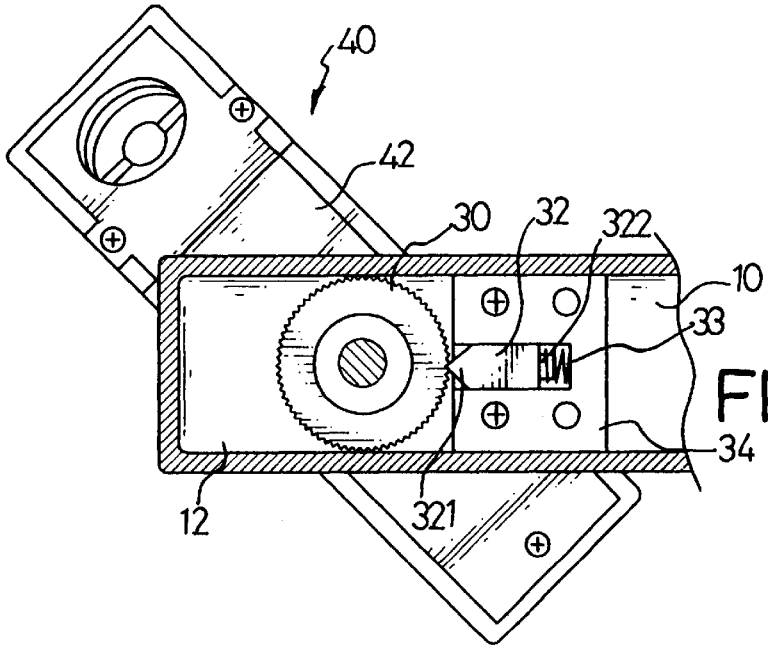

Referring to FIGS. 4–6, a slidable gear lock (32) has an inverted V-top with a tip (321) and a cylinder (322) protruding from a bottom surface of the slidable gear lock (32). A spring (33) is mounted around the cylinder (322). The slidable gear lock (32) is disposed in the socket (15) defined in the protruding piece (14), and the spring (33) abuts a bottom wall defining the socket(15), whereby the slidable gear lock (32) is pushed by the spring (33) and the tip (321) meshes with the gear (30). A plate (34) then covers the socket (15) and secures the slidable gear lock (32) and the spring (33) in the socket (15).

With reference specifically to FIG. 2, the rod (44) extends through the hollow axle (31). The rod (44) has a first end connected to the shaft (23) of the lever (20) and a second end connected to the arm (45) of the swivel head (40). The arm (45) is further connected to the riveting mechanism of the collet tube (41).

When in operation, the lever (20) and the handle (10) are pushed toward each other, and due to connections of the rod (44) to the arm (45) and the arm (45) to pull up the collet tube (41) to activate the riveting mechanism, and the riveting mechanism deforms a blind rivet to fasten work pieces together. After the blind rivet is deformed and securely fastens the work pieces together, the lever (20) and the handle (10) are released and move away from each other due to a return force provided by the torsion spring (27).

With reference to FIGS. 4–6, the swivel head (40) is rotatable with respect to the handle (10). The meshing of the gear (30) with the tip (321) of the slidable gear lock (32) allows the swivel head (40) to be finely-adjustable, and whenever the swivel head (40) is rotated, a clicking sound is made due to meshing between the gear (30) and the slidable gear lock (32) to inform a user. Furthermore, when turning the swivel head (40) to rotate the gear (30), the slidable gear lock (32) moves back and forth made by the tip (321) of the slidable gear lock (32) meshing the gear (30) and the recovery force of spring (33). Even though the tip (321) of the slidable gear lock (32) and the teeth of the steering gear (30) got worn-out due to rubbing, the back-and-forth movement can be as a complement to the tip (321) of the slidable gear lock (32) and the gear (30) to prolong the operation life of the slidable gear lock (32), the gear (30) and the rivet tool as well.

From the above description, it is noted that the invention has the following advantages:

1. fine adjustability. The swivel head (40) is finely-adjustable, that is, the user can finely adjust the swivel head (40), and the meshing of the gear (30) and the slidable gear lock (32) will provide a positioning to the swivel head (40).
2. audible security. The clicking sound is made whenever turning the swivel head (40), and the clicking sound can inform the user of rotation of the swivel head (40) and also alert the user of undesired rotation of the swivel head (40) during operation.
3. prolonged operation life. The back-and-forth movement made by the tip (321) of the slidable gear lock (32) meshing the gear (30) and the recovery force of the spring (33) can be as a complement to the tip (321) of the slidable gear lock (32) and the gear (30) to prolong the operation life of the slidable gear lock (32), the gear (30), and the rivet tool as well.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A rivet tool comprising:

a handle with a front portion and a first slope formed on the front portion of the handle and being inclined to a bottom face of the handle, the first slope defining a first through hole and having a protruding piece formed adjacent to the first through hole, the protruding piece defining a socket;

a lever pivotally connected to the handle;

a swivel head with a second slope to engage with the first slope of the handle, the second slope defining a second through hole to communicate with the first through hole, the swivel head having a collet tube with a riveting mechanism for receiving and deforming a blind rivet;

a hollow axle having a first end and a second end, the first end having a gear formed thereon to abut the first slope and the second end securely connected to the second slope of the swivel head, and the hollow axle extending through the first through hole and the second through hole;

a slidable gear lock movably received in the socket of the protruding piece, the slidable gear lock having an inverted V-top and a tip of the inverted V-top, the tip meshed with the gear of the hollow axle and a spring to provide recovery force to the slidable gear lock; and a plate covering the socket to secure the slidable gear lock and the spring in the socket, whereby the swivel head is able to be finely adjustable with respect to the handle and movement of the slidable gear lock allows the tip to selectively engage with the gear.

2. The rivet tool as claimed in claim 1, wherein the second end of the hollow axle and the second slope of the swivel head are securely welded together.

3. The rivet tool as claimed in claim 1, wherein the second end of the hollow axle and the second slope of the swivel head are securely riveted together.

4. The rivet tool as claimed in claim 1, wherein the protruding piece and the first slope are integrally formed.

5. The rivet tool as claimed in claim 1, wherein the protruding piece and the first slope are securely welded together.

6. The rivet tool as claimed in claim 1, wherein the protruding piece and the first slope are securely riveted together.

7. The rivet tool as claimed in claim 1 further comprising a leaf spring mounted around the hollow axle and sandwiched between the gear and the first slope to occupy a gap between the gear and the first slope.

8. The rivet tool as claimed in claim 1 further comprising a washer mounted around the hollow axle and sandwiched between the first slope and the second slope to reduce rubbing therebetween.

* * * * *